United States Patent [19]

Martin

[11] Patent Number: 4,509,747

[45] Date of Patent: Apr. 9, 1985

[54] ARM WRESTLING APPARATUS

[75] Inventor: Michael L. Martin, Canyon, Tex.

[73] Assignee: Martin Research & Development, Canyon, Tex.

[21] Appl. No.: 514,463

[22] Filed: Jul. 18, 1983

[51] Int. Cl.[3] ..... A63B 21/00; A63B 21/16

[52] U.S. Cl. ..... 272/136; 272/901

[58] Field of Search ..... 272/901, 67, 134–139, 272/142, 146; 73/379–381; 273/1 R, 1 G, 1 GH, 1 GI

[56] References Cited

U.S. PATENT DOCUMENTS

| | | | |
|---|---|---|---|
| D. 256,822 | 9/1980 | Ozzimo | 272/901 X |
| 3,019,019 | 1/1962 | Forte | 272/117 |
| 3,467,376 | 9/1969 | Feinberg | 272/67 |
| 3,475,024 | 10/1969 | Lewis | 272/117 |
| 3,536,326 | 10/1970 | Yatrides | 272/137 |
| 3,559,487 | 2/1971 | Parlato | 73/380 |
| 3,662,602 | 5/1972 | Weiss | 272/901 X |
| 3,743,284 | 7/1973 | Rhodes et al. | 273/1 R |
| 3,815,904 | 6/1974 | Weiss et al. | 272/136 |
| 3,947,025 | 3/1976 | Hobby, Jr. | 272/135 |
| 3,982,757 | 9/1976 | McDonnel | 272/134 |
| 4,063,727 | 12/1977 | Hall | 272/136 |
| 4,157,179 | 6/1979 | Ecklor, Jr. | 272/67 |
| 4,184,675 | 1/1980 | Rogerson | 272/67 |

*Primary Examiner*—Robert A. Hafer
*Assistant Examiner*—Chris Coppens
*Attorney, Agent, or Firm*—Jerry W. Mills; Gregory M. Howison; Nina L. Medlock

[57] ABSTRACT

An arm wrestling apparatus (10) includes a base (12) with a telescoping arm (20) pivoted about pivoting brackets (16) and (18). A resilient band (50) is disposed between a stud (48) and a stud (46). The stud (46) is mounted on a reinforcing member (42) that is oriented at an essentially 45° angle with respect to the base (12). Rotation of the telescoping arm (20) stretches the resilient band (50) and directs the force primarily along the longitudinal axis of the support member (42). An additional reinforcing member (40) is disposed at an essentially right angle with respect to the reinforcing member (42). A stud (44) is disposed thereon such that the resilient band (50) can be disposed thereon to reverse the rotation thereof. A limiting pin (32) is disposed on the brackets (16) and (18) to limit rotation to essentially 90°.

9 Claims, 3 Drawing Figures

ARM WRESTLING APPARATUS

TECHNICAL FIELD

The present invention pertains in general to arm wrestling apparatus and, more particularly, to an arm wrestling apparatus with a structurally reinforced member for opposing the forces incurred during arm wrestling exercises.

BACKGROUND OF THE INVENTION

Arm wrestling has become a sport which requires a great deal of practice in order to properly prepare one's self for competition. Since the competition requires the mating of two individuals with relatively equal strength, it is sometimes difficult to find a partner to train with that can provide the requisite competitive training. Conventional weight machines do not replace an arm wrestling partner since the muscles involved in arm wrestling are not properly stressed by this equipment. This has resulted in the development of a number of apparatus for simulating the arm wrestling exercise with variable weights attached thereto. Examples of these apparatus are U.S. Pat. No. 3,019,019 issued to Forte, U.S. Pat. No. 3,815,904 issued to Weiss and U.S. Pat. No. 4,157,179 issued to Ecklor, Jr. These devices utilize various forms of resilient members or pulling mechanisms with variable weights attached thereto for restraining movement of the hand about an arcuate path with the elbow resting on a stationary spot. This effectively exercises the arm for competition in arm wrestling. However, these apparatus are somewhat bulky or require a bulky table to support the stress member. Since individuals involved in arm wrestling competition are above average in strength, the structure of these arm wrestling exercise apparatus must be relatively durable. This usually results in a fairly bulky device.

In view of the above disadvantages, there exists a need for arm wrestling exercise apparatus that retains the structural integrity when utilized by competitive individuals while maintaining a fairly lightweight and portable structure.

SUMMARY OF THE INVENTION

The present invention disclosed and claimed herein comprises an arm wrestling apparatus which includes a base with a pivoting arm pivoted at one end thereto. A resilient band is disposed at one point on the pivoting arm and at another point on a reinforcing member. The reinforcing member is disposed in a plane at right angles to the base with the second point disposed thereon along the longitudinal axis thereof. Pivoting of the pivoting arm results in an increasing force between the first and second point with the primary force vector directed along the longitudinal axis of the force member. A second reinforcing member is attached to the first member at an essentially right angle thereto for reinforcing the force member against force vectors directed off axis to the first member.

In yet another embodiment of the present invention, the pivoting arm is telescoping to provide for variable height adjustment. A limiting pin is disposed adjacent the pivoting point of the pivoting arm to limit the pivoting freedom to essentially 90°.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
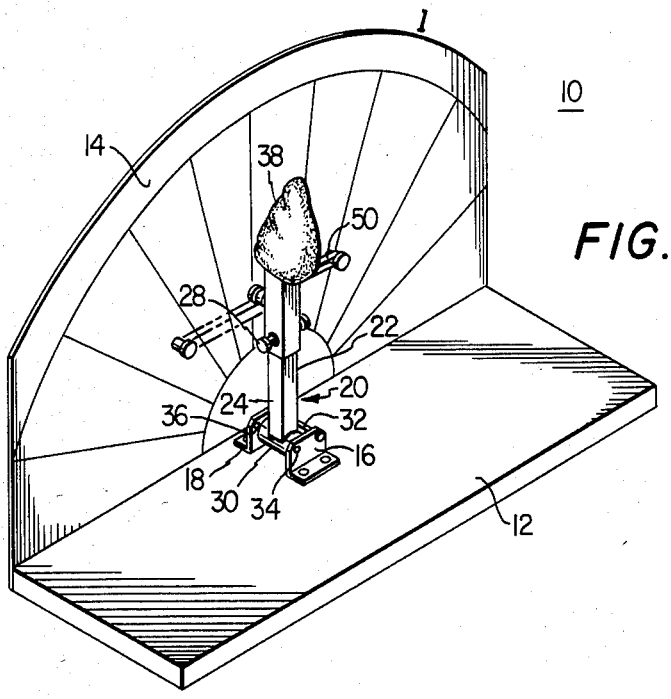
FIG. 1 illustrates a perspective view of the arm wrestling apparatus of the present invention.

Referring now to FIG. 1, there is illustrated a perspective view of an arm wrestling device 10. The arm wrestling device 10 includes a base 12 having a rectangular shape with a planar upper and lower surface. A backboard layer 14 is disposed on one edge of the base 12 and oriented perpendicular to the planar upper and lower surfaces thereof. The backboard 14 provides a decorative function only.

A pivoting bracket 16 and a pivoting bracket 18 are mounted on the upper surface of the base 12 for supporting a pivoting arm 20. The pivoting arm 20 has an upper section 22 and a lower section 24. The upper section 22 slideably fits over the lower section 24 to provide a telescoping action. Locking pins 28 are provided that are threadedly mounted on the upper section 22. When in place, the locking pins 28 prevent telescoping of the upper section 22 with respect to the lower section 24 by pressing against the exterior surface of the lower section 24. The lower section 24 is attached at the distal end thereof to a pivoting member 30. The pivoting member 30 is disposed between the pivoting brackets 16 and 18 and is operable to pivot thereon. A limiting pin 32 is also disposed between the pivoting brackets 16 and 18 and parallel to the pivoting axis of the pivoting arm 20. The limiting pin 32 is disposed such that it is slightly above the plane in which the pivoting axis of the pivoting arm 20 lies so as to prevent the pivoting arm 20 from pivoting to a point parallel with the upper surface of the base 12. The limiting pin 32 is removable from the position illustrated and orifices 34 and 36 are provided on the pivoting brackets 16 and 18, respectively, to receive the limiting pin 32 such that movement in the opposite pivoting direction of the arm 20 can be limited.

Figure 3:
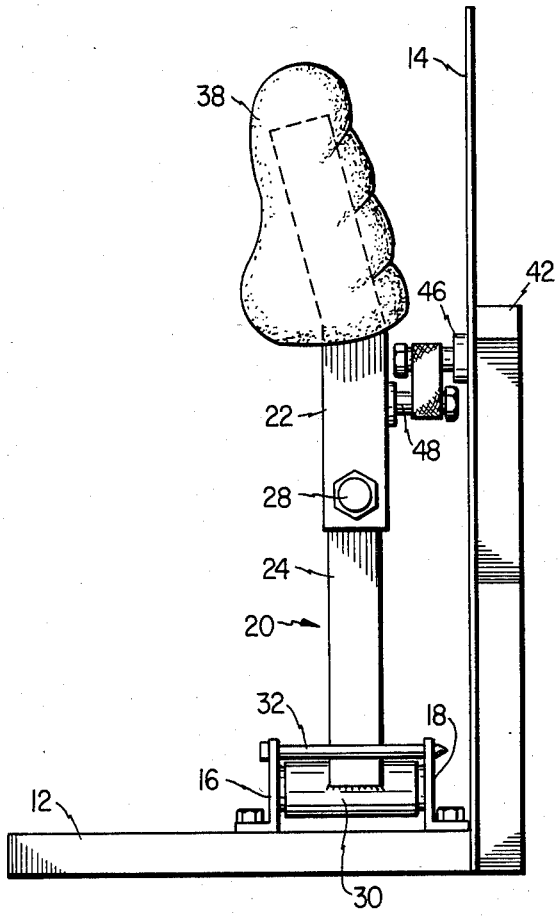
FIG. 3 illustrates a side view of the arm wrestling apparatus of FIG. 1.

A hand grip 38 is disposed on the upper distal end of the upper section 22 of the pivoting arm 20. The hand grip 38 can be formed of any plastic material and, in the preferred embodiment, conforms to the shape of an operator's hand. The hand grip 38 can either be formed separate from the upper section 22 or molded around the upper section 22. As best illustrated in FIG. 3, the upper section 22 extends into the hand grip 38, as indicated by phantom lines. The portion of the upper section 22 that is internal to the hand grip 38 forms an acute angle with the longitudinal axis of the pivoting arm 20. This angle is approximately 10°. This slight angle allows the wrist of the operator to exercise in a more normal fashion to that encountered in arm wrestling with another individual rather than the apparatus 10.

Figure 2:
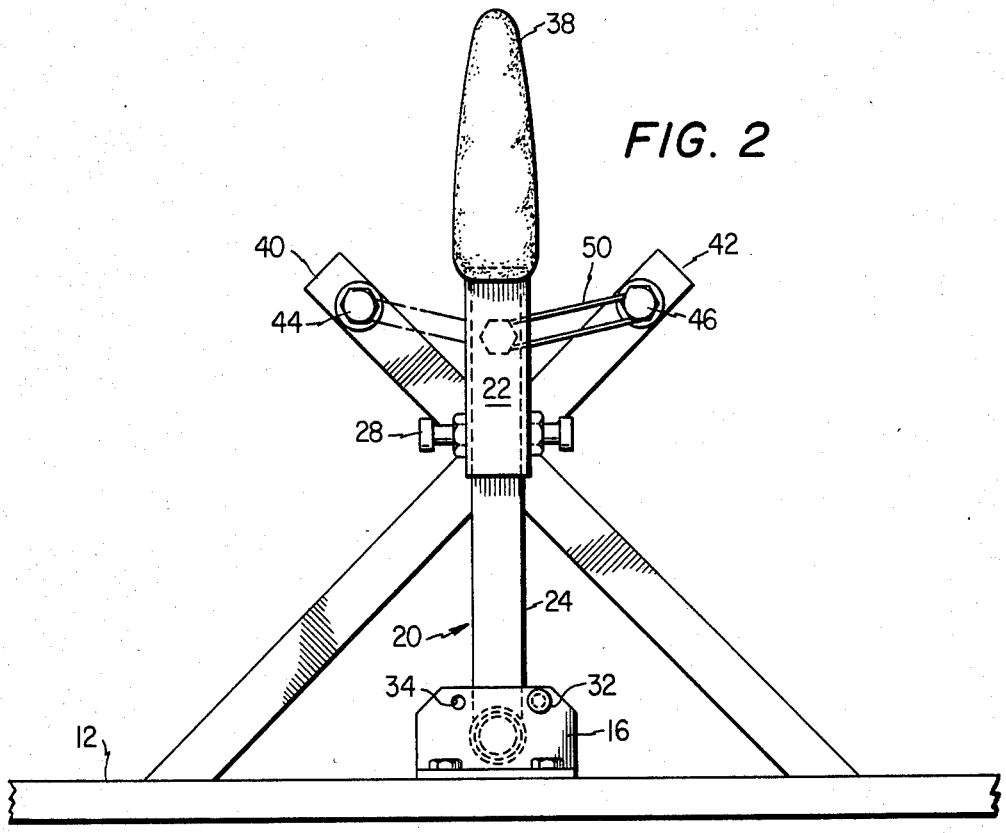
FIG. 2 illustrates a frontal view of the arm wrestling device of FIG. 1 without the back plane.

As best illustrated in FIG. 2 with the backboard 14 removed, a reinforcing member 40 and a reinforcing member 42 are disposed in a plane perpendicular to the planar surface of the base 12. The reinforcing members 40 and 42 are oriented at essentially right angles with respect to each other and intersect each other at a point midway between the ends thereof. The reinforcing members 40 and 42 are attached together at the intersection point thereof. This basically forms an "X" shape.

The reinforcing member 40 has a stud 44 disposed on the distal end thereof with respect to the planar surface of the base 12 and protrudes outward therefrom and over the upper planar surface of the base 12. The reinforcing member 42 has a similar stud 46 disposed on the distal end thereof with respect to the planar surface of the base 12 and protruding outward therefrom over the planar surface of the base 12. The upper section 22 of the pivoting arm 20 has a stud 48 protruding outward therefrom towards the backboard 14. A resilient band 50 is disposed between the stud 46 on the reinforcing member 42 and the stud 48 on the upper section 22 of the pivoting arm 20. The reinforcing band 50 provides an elastic force that increases as the distance between the stud 48 on the pivoting arm 20 and the stud 46 on the reinforcing member increases as a result of pivoting the arm 20. The band 50 and the limiting pin 32 are placed as illustrated in FIGS. 1–3, such that the pivoting arm 20 is utilized by a right handed individual only. To utilize the device for a left handed individual, it is only necessary to dispose the band 50 between the stud 44 on the reinforcing member 50 and the stud 48 on the upper section 22 of the pivoting arm 20 and to remove the limiting pin 32, as illustrated in FIG. 1, and place it in the orifices 34 and 36.

The reinforcing members 40 and 42 are operable to provide the maximum amount of reinforcement to the force applied by the band 50 as it is stretched by the pivoting arm 20 during operation. By disposing the reinforcing member 42 at an acute angle with respect to the upper surface of the base 12, the pivoting motion of the arm 20 with respect thereto results in a force having a vector oriented along the longitudinal axis of the reinforcing member 42. As the pivoting arm rotates, the relative magnitude of the parallel force vector increases, thereby directing essentially all of the force along the longitudinal axis of the reinforcing member 42. Therefore, structural integrity is maintained without requiring additional supporting members. The intersection of the two reinforcing members 40 and 42 provides an opposing force for the remaining force vector of the force resulting from pivoting of the arm 20 to thereby provide additional support. However, the main portion of the force is directed along the longitudinal axis of the respective reinforcing members 40 or 42 that are connected to the pivoting arm 20 by the band 50. The reinforcing members 40 and 42 form an essentially 45° angle with respect to the upper planar surface of the base 12. In this manner, the respective reinforcing member that is connected to the pivoting arm 20 by the band 50 essentially forms the "cord" for the arcuate path traversed by the arm 20.

In summary, there has been provided an arm wrestling apparatus that utilizes a telescoping arm pivoted on a bracket that is mounted on a base. A pair of reinforcing members are oriented at essentially right angles to each other and mounted on the base at right angles thereto. An elastic band is disposed between the pivoting arm and the end of the reinforcing members such that pivoting of the pivoting arm results in a force vector oriented along the longitudinal axis of the respective one of the reinforcing members that is attached to the pivoting arm. The elastic band is removable such that the direction of pivot can be changed by attaching the band to the other of the reinforcing members. A limiting pin is disposed on the pivoting bracket such that the pivoting arm has only 90° of freedom.

Although the preferred embodiment has been described in detail, it should be understood that various changes, substitutions and alterations can be made therein without departing from the spirit and scope of the invention as defined by the appended claims.

What is claimed is:

1. An arm wrestling apparatus, comprising:

a base;

a pivoting arm pivoted at one end to said base;

resilient force means attached to a first point on said pivoting arm and to a second and stationary point for stretching to provide an opposing force that increases as the distance between said first and second point increases;

a first longitudinal reinforcing member disposed in a plane at right angles to said base with said second point disposed thereon along the longitudinal axis thereof, said first member forming an acute angle with respect to the surface of said base such that the force resulting from pivoting of said arm is primarily directed along the longitudinal axis thereof, said first member essentially oriented along the cord of the arcuate path traversed by said first point and providing maximum reinforcement therealong such that the opposing force vector resulting from said opposing force is essentially directed along the longitudinal axis of said first member when said pivoting arm is proximate its maximum rotation; and a second longitudinal reinforcing member attached to said first member at an essentially right angle thereto for reinforcing said first member against force vectors directed off axis to said first member that results from said pivoting arm not being proximate its maximum rotation.

2. The arm wrestling apparatus of claim 1 further comprising means for limiting the rotation of said pivoting arm to essentially 90° of pivot from the vertical position to a prone position with respect to the planar surface of said base.

3. The apparatus of claim 1 wherein said resilient force means comprises a longitudinal resilient member.

4. The apparatus of claim 1 wherein said resilient means comprises a band of resilient material and said first and second points comprise studs to which said band is attached.

5. The apparatus of claim 1 wherein said first and second longitudinal members are oriented at essentially a 45° angle with respect to the upper surface of said base.

6. The apparatus of claim 1 wherein said pivoting arm has a hand grip molded to the end thereof.

7. The apparatus of claim 6 wherein the distal end of said pivoting arm with respect to the planar surface of said base forms an acute angle with the longitudinal axis of said pivoting arm and extending outward from said reinforcing members.

8. The apparatus of claim 1 wherein said pivoting arm is telescoping to provide an adjustment for length thereof.

9. An arm wrestling apparatus, comprising:

a rectangular base;

a pivoting bracket attached to the surface of said base;

a telescoping arm having a telescoping portion and a stationary portion, the stationary portion pivoted at one end to said pivoting bracket in a plane at a right angle to said base;

a hand grip disposed on the end of the telescoping portion of said telescoping arm distal to the planar surface of said base and disposed at an acute angle with respect to the longitudinal axis of said telescoping arm;

a first reinforcing member disposed in a plane perpendicular to said base and at an essentially 45° angle with the surface of said base, said plane parallel to the plane of rotation of said telescoping arm;

a second longitudinal member disposed in the same plane as said first longitudinal member and attached to said base at an essentially 45° angle thereto, said first and second longitudinal members attached together along the longitudinal axes thereof at essentially a 90° angle therebetween;

a first stud disposed on the telescoping portion of said telescoping arm and extending outward towards said reinforcing members;

a second stud disposed on the distal end of said first reinforcing member and extending outward towards said telescoping arm;

a third stud disposed on the distal end of said second reinforcing member and extending outwards towards said telescoping arm;

said second and third studs distal with respect to the juncture of said first and second reinforcing member a resilient band operable to be disposed between said first and second stud to provide an opposing force between said telescoping arm and said reinforcing member, said resilient band also operable to be disposed between said first and third stud to provide an opposing force therebetween in the opposite direction as that provided by said resilient band disposed between said first and second stud, pivoting of said telescoping arm about said pivoting bracket stretching said resilient band such that the force vector resulting from the opposing force on the one of said reinforcing members having said resilient band interface therewith through the respective one of said first and second studs is primarily directed along the longitudinal axis thereof when said telescoping arm is proximate its maximum rotation and the opposing force provided by said resilient band is maximum, the remaining one of said reinforcing members providing support for the remaining force vectors that are off axis as a result of said resilient band not being parallel with the longitudinal axis of the one of said members having said band interfaced therewith, increased rotation of said telescoping arm about said pivot point resulting in increased force on said telescoping arm; and means for limiting the freedom of motion of said telescoping arm about said pivoting bracket to essentially 90° in the desired direction thereof.

* * * * *